US005141290A

United States Patent [19]

Mairon

[11] Patent Number: 5,141,290

[45] Date of Patent: Aug. 25, 1992

[54] TOOTHBRUSH

[75] Inventor: Omri Mairon, Kibbutz Ruchama, Israel

[73] Assignee: Hamivreshet Brush Factory, Israel

[21] Appl. No.: 693,190

[22] Filed: Apr. 29, 1991

[30] Foreign Application Priority Data

May 4, 1990 [IL] Israel ..... 94294

[51] Int. Cl.[5] ..... A46D 3/00

[52] U.S. Cl. ..... 300/21; 15/167.1

[58] Field of Search ..... 15/167.1, 162.2, 167.3, 15/159 R; 300/21

[56] References Cited

U.S. PATENT DOCUMENTS 2,099,688 11/1937 Hill et al. ..... 15/167.1 X
3,162,572 12/1964 Grandquist et al. ..... 15/167.1 X
3,380,848 4/1968 Horowitz ..... 15/167.1 X
3,605,163 9/1971 Bechtold ..... 15/167.1 X
3,691,585 9/1972 Flom ..... 15/167.1 X

FOREIGN PATENT DOCUMENTS 2616317 12/1988 France ..... 15/167.1

*Primary Examiner*—Douglas D. Watts
*Attorney, Agent, or Firm*—Robbins, Dalgarn, Berliner & Carson

[57] ABSTRACT

The invention provides a toothbrush of the type having a plastic head and bristles terminating in the head and extending therefrom in an array, the toothbrush comprising an antibacterial composition embedded in pores created in the plastic head, which antibacterial composition is slowly releasable from the toothbrush into the buccal cavity during repeated use thereof during the life of the brush.

10 Claims, 1 Drawing Sheet

TOOTHBRUSH

The present invention relates to a toothbrush of the type having a plastic head and bristles terminating in said head and extending therefrom in an array, said toothbrush being characterized by having an antibacterial composition embedded in pores in said head for slow release therefrom into the buccal cavity during the life of the brush and to processes for the preparation thereof.

Said head can be integral with the handle of the toothbrush or can be a replaceable head attachable to a suitable handle and said plastic head is preferably made of polypropylene, cellulose acetate or styrene acrylonitrile plastic.

The term antibacterial used herein is intended to include all agents which are known or used to kill bacterial microorganisms and which can be safely introduced into the oral cavity whether said agent is called an antibacterial agent or an antiseptic agent.

Preferred agents are chlorohexidine and cetylpyridinum chloride, however, other agents such as benzalconium chloride, benzalthonium, essential oils, alexidine, sanguinarine, aminofluorides, sulfonamides, phenolics, mercurials, quaternary ammonium compounds and the like and mixtures thereof can also be used.

Toothbrushes having incorporated therein a bacteriostatic material, were contemplated already more than fifty years ago as described e.g., in U.S. Pat. No. 2,216,333. Said Patent, however, was directed to the concept of a toothbrush which was self-sterilizing and which incorporated bactericides "classed generally as photo-active or radio-active substances as, for example, certain salts that normally or when activated emanate bactericidal rays."

The state of the knowledge has progressed considerably since then and later patents do not relate to "bactericidal rays" however, U.S. Pat. Nos. 2,099,688, 3,162,572; 3,380,848; 3,605,163 and 3,864,468 all disclose various bacteriostatic additions to the bristle portion of the toothbrush for sanitizing and sterilizing said bristles.

In contradistinction to said patents the present invention is directed to a new type of toothbrush and a method for the preparation thereof, wherein said toothbrush is characterized by having an antibacterial composition embedded in pores of the toothbrush head for slow release therefrom into the buccal cavity of the user during repeated use of the toothbrush during the life thereof.

More particularly the present invention provides a toothbrush of the type having a plastic head and bristles terminating in said head and extending therefrom in an array, said toothbrush comprising an antibacterial composition embedded in pores created in said head, which antibacterial composition is slowly releasable from said toothbrush into the buccal cavity during repeated uses thereof during the life of the brush.

In an article by M. Friedman et al in International Journal of Pharmaceutics 44:243–247 (1988) it is explained and described that dental caries and periodontal disease, the two most important oral diseases, may be attributed to dental plaque. Plaque control is primarily concerned with plaque removal but, since complete mechanical plaque removal is difficult for the ordinary patient, control of the residual plaque by an antibacterial agent becomes important.

Among the chemical agents thus far clinically tested for their Potential to inhibit the formation of plaque. chlorhexidine has shown the greatest promise. The high plaque-reducing property of chlorhexidine in vivo has been attributed to its high germicidal activity and its level of adsorption to enamel, tooth pellicle, oral mucosa and salivary proteins from which sites chlorhexidine is later released to provide prolonged inhibition of oral bacterial.

Cetylpyridinium chloride (CPC) is a quaternary ammonium compound whose properties are similar to those of other surface-active cationic antiseptics and it has been shown that CPC in vitro had an inhibitory effect on oral streptococci and staphylococci which was equal to or better than that of chlorhexidine.

Thus, said article and other articles by M. Friedman, et al. e.g. in Journal of Controlled Release 1:157–160 (1984), Elsevier Science Publishers B. V. Amsterdam, suggest the prevention of plaque accumulation by local application of a sustained release delivery system or chlorhexidine or inhibition of plaque formation by a sustained release delivery system for cetylpyridinium chloride using ethyl cellulose films containing antimicrobial agents and applying the same directly to the teeth or to bodies positioned in the mouth and retained therein.

As will be realized, in contradistinction to said approach, there are major advantages to incorporating such antibacterial agents in the head of a toothbrush so that a small amount of antibacterial agent is released each time the brush is used, rather than requiring a patient to frequently visit a dentist to have sustained release films introduced into the patient's mouth.

Furthermore, the mass production and distribution of such toothbrushes allows the widespread household use thereof, with each person's own favorite toothpaste, thereby improving the chances of market acceptability of this beneficial delivery system for antibacterial agents.

Thus the present invention also provides a process for producing a toothbrush of the type having a plastic head and bristles terminating in said head and extending therefrom in an array, said toothbrush being characterized by having an antibacterial composition embedded in pores in said head for slow release therefrom into the buccal cavity during the life of the brush said process comprising immersing said head in a solution comprising a solvent capable of creating pores in said plastic head and an antibacterial compound whereby pores are formed in said head and said solution permeates said pores and then evaporating said solvent thereby leaving the antibacterial compound embedded in said toothbrush head for sustained release therefrom into the buccal cavity of a user during use thereof.

Preferred solvents for use in the present process are methylene chloride, acetone, ethylene chloride, methyl acetate and chloroform. Methylene chloride is especially preferred for use in the present invention.

Preferably said solution further comprises a release enhancer selected from ethanol, cyclohexane, isopropanol, pentane or ethyl acetate, to enhance the release of the antibacterial agent.

Especially preferred for use in the present invention is a mixture of methylene chloride and ethanol Preferably said solution further comprises a humectant selected from glycerine, sorbitol hydrogenate, starch hydrolyzate or polyethylene glycol to maintain moisture in the pores of the brush and increase the availability of the antibacterial agent.

In a variation of the above method it is possible to add a hydrophobic polymer or wax such as one selected from carnauba wax, stearic acid, cellulose derivatives, polyethylenes, methacrylic acid polymers, and especially one selected from glyceryl stearate, carnauba wax, stearyl alcohol, ethyl cellulose, polyethylene glycol, cellulose acetate and a methacrylic acid polymer to the solution with mixing to effect the full dissolution thereof, whereafter the antibacterial agent and other optional components are added.

This solution then results not only in the embedding of antibacterial agent in pores created in the toothbrush head but also in the further coating of the brush head with an antibacterial agent containing polymer or wax, thus increasing the amount of antibacterial agent available for release.

While the invention will now be described in connection with certain preferred embodiments in the following examples and with reference to the accompanying figures so that aspects thereof may be more fully understood and appreciated, it is not intended to limit the invention to these particular embodiments. On the contrary, it is intended to cover all alternatives, modifications and equivalents as may be included within the scope of the invention as defined by the appended claims. Thus, the following examples which include preferred embodiments will serve to illustrate the practice of this invention, it being understood that the particulars shown are by way of example and for purposes of illustrative discussion of preferred embodiments of the present invention only and are presented in the cause of providing what is believed to be the most useful and readily understood description of formulation procedures as well as of the principles and conceptual aspects of the invention.

EXAMPLES 1-3

Figure 1:
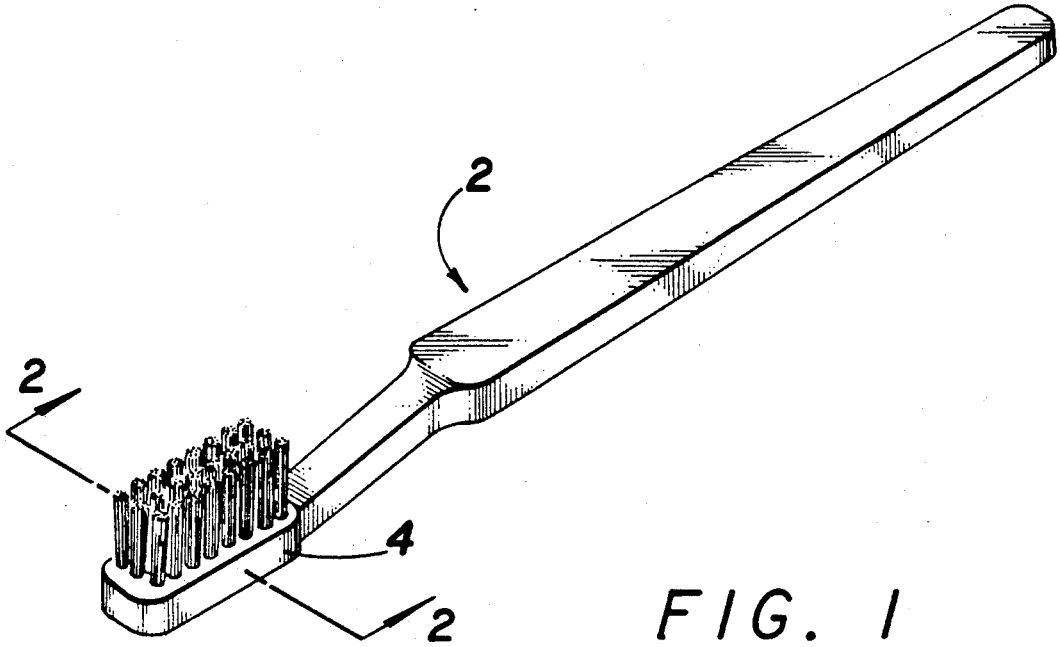
FIG. 1 is a perspective view of a toothbrush 2 incorporating the invention.
Figure 2:
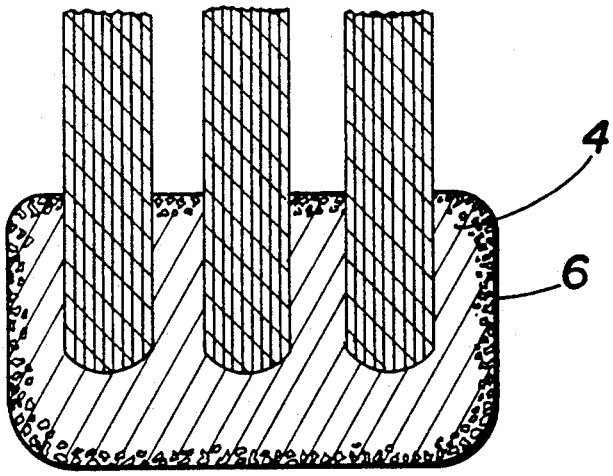
FIG. 2 is a cross-section view on an enlarged scale of the head 4 of a toothbrush having antibacterial composition containing pores 6 therein.

Three solutions were prepared for use in the process of the present invention with the following enumerated amounts of components.

EXAMPLE 1

20 cc methylene chloride, 4 g cetylpyridinium chloride and 0.5 g glycerine.

EXAMPLE 2

15 cc methylene chloride, 4 g cetylpyridinium chloride, 0.5 g glycerine and 0.1 g ethyl cellulose.

EXAMPLE 3

22 cc methylene chloride, 4 g cetylpyridinium chloride and 0.5 cc glycerine and 0.1 ethyl cellulose To test the release of antibacterial agent from toothbrushes prepared according to the invention, three toothbrushes having a head of polypropylene were immersed for about 15 seconds respectively into each one of said solutions, were dried at room temperature and then tested by immersion in 5 ml. of water for 3 minutes. At the end of said period each brush was transferred to a new 5 ml. solution of water for an additional 3 minutes. This process was repeated 25 times with the brush prepared with solution 1 and 55 times with the brushes prepared with solutions 2 and 3.

The amount of antibacterial agent released in each sequential immersion was measured by means of u.v. spectrophotometer at 259 nm for cetylpyridinium chloride. Experiments were triplicated and mean values recorded. Reproducibility was within 8% of the mean.

EXAMPLE 1

| Immersion Number | Conc. (mcg/ml) |
|---|---|
| 1 | 15880 |
| 2 | 1080 |
| 3 | 370 |
| 4 | 176 |
| 5 | 110 |
| 6 | 100 |
| 7 | 110 |
| 8 | 63 |
| 9 | 40 |
| 10 | 30 |
| 11 | 30 |
| 12 | 19 |
| 13 | 15 |
| 14 | 9 |
| 15 | 5 |
| 16 | 160 |
| 17 | 80 |
| 18 | 27 |
| 19 | 134 |
| 20 | 50 |
| 21 | 34 |
| 22 | 4 |
| 23 | 67 |
| 24 | 49 |
| 25 | 11 |

EXAMPLE 2

| Immersion Number | Conc. (mcg/ml) |
|---|---|
| 1 | 7250 |
| 2 | 3510 |
| 3 | 1550 |
| 4 | 920 |
| 5 | 700 |
| 6 | 470 |
| 7 | 360 |
| 8 | 370 |
| 9 | 350 |
| 10 | 370 |
| 11 | 290 |
| 12 | 220 |
| 13 | 250 |
| 14 | 108 |
| 15 | 120 |
| 16 | 90 |
| 17 | 120 |
| 18 | 80 |
| 19 | 189 |
| 20 | 164 |
| 21 | 100 |
| 22 | 101 |
| 23 | 79 |
| 24 | 90 |
| 25 | 74 |
| 26 | 60 |
| 27 | 50 |
| 28 | 50 |
| 29 | 67 |
| 30 | 50 |
| 31 | 37 |
| 32 | 34 |
| 33 | 26 |
| 34 | 39 |
| 35 | 25 |
| 36 | 26 |

-continued

| Immersion Number | Conc. (mcg/ml) |
|---|---|
| 37 | 33 |
| 38 | 20 |
| 39 | 25 |
| 40 | 19 |
| 41 | 60 |
| 42 | 7 |
| 43 | 15 |
| 44 | 14 |
| 45 | 14 |
| 46 | 10 |
| 47 | 11 |
| 48 | 4 |
| 49 | 14 |
| 50 | 17 |
| 51 | 5 |
| 52 | 6 |
| 53 | 9 |
| 54 | 9 |
| 55 | 10 |

EXAMPLE 3

| Immersion Number | Conc. (mcg/ml) |
|---|---|
| 1 | 20160 |
| 2 | 1600 |
| 3 | 1010 |
| 4 | 490 |
| 5 | 110 |
| 6 | 206 |
| 7 | 173 |
| 8 | 93 |
| 9 | 22 |
| 10 | 194 |
| 11 | 160 |
| 12 | 260 |
| 13 | 149 |
| 14 | 136 |
| 15 | 100 |
| 16 | 55 |
| 17 | 58 |
| 18 | 43 |
| 19 | 49 |
| 20 | 38 |
| 21 | 155 |
| 22 | 45 |
| 23 | 30 |
| 24 | 166 |
| 26 | 199 |
| 27 | 108 |
| 28 | 189 |
| 29 | 108 |

-continued

| Immersion Number | Conc. (mcg/ml) |
|---|---|
| 30 | 100 |
| 31 | 40 |
| 32 | 100 |
| 33 | 80 |
| 34 | 80 |
| 35 | 49 |
| 36 | 18 |
| 37 | 12 |
| 38 | 24 |
| 39 | 13 |
| 40 | 13 |
| 41 | 17 |
| 42 | 30 |
| 43 | 55 |
| 44 | 29 |
| 45 | 24 |
| 46 | 110 |
| 47 | 48 |
| 48 | 90 |
| 49 | 3 |
| 51 | 27 |
| 52 | 24 |
| 53 | 18 |
| 54 | 23 |
| 55 | 13 |

EXAMPLES 4-30

Twenty-seven solutions for use in the process of the present invention were prepared with different components as set forth in Table 4 hereinafter.

a) Solution preparation

To a solution of methylene chloride, with or without ethanol, there was first added, with mixing, polyethylene glycol 400, or in the solutions without polymer, an antibacterial agent, e.g., chlorhexidine or cetylpyridinium was immediately added to the solution at ambient temperature with or without further components as listed.

b) Embedding process

Two toothbrushes had their heads respectively immersed for about 15 seconds into each one of said solutions, a first toothbrush of each set of brushes having a head and handle of polypropylene and the second toothbrush having a head and handle of styrene acrylonitrile.

After withdrawal of the fifty four toothbrushes thus prepared from said solutions the solvent evaporated therefrom at room temperature.

TABLE 4

| | Coating Solution Compositions | | | | | | | |
|---|---|---|---|---|---|---|---|---|
| Formulation | Ethanol (ml) | Methylene Chloride (ml) | Peg (gm) | Glycerine (gm) | CPC (gm) | CHX (gm) | EC (gm) | Eudragite (gm) |
| 4 | 5 | 45 | 0.5 | — | 3 | — | — | 8 |
| 5 | 5 | 45 | 1.0 | — | 3 | — | — | 8 |
| 6 | 5 | 45 | 1.5 | — | 3 | — | — | 8 |
| 7 | 5 | 45 | 1.5 | — | 3 | — | 4 | — |
| 8 | 5 | 45 | — | — | 3 | — | 4 | — |
| 9 | 5 | 45 | 1.0 | — | 3 | — | 4 | — |
| 10 | 5 | 45 | 0.5 | — | 3 | — | 4 | — |
| 11 | 10 | 50 | — | — | 4 | — | — | — |
| 12 | 20 | 30 | — | — | 3 | — | 4 | — |
| 13 | 20 | 30 | 0.5 | — | 3 | — | 4 | — |
| 14 | 20 | 30 | 1.0 | — | 3 | — | 4 | — |
| 15 | 10 | 50 | 1.0 | — | 4 | — | — | — |
| 16 | 10 | 50 | 1.0 | — | 8 | — | — | — |
| 17 | 25 | 25 | 1.0 | — | 4 | — | — | — |
| 18 | 25 | 25 | 2.0 | — | 4 | — | — | — |
| 19 | 25 | 25 | — | 1 | 4 | — | — | — |
| 20 | 25 | 25 | — | 2 | 4 | — | — | — |
| 21 | 1 | 50 | 0.5 | — | 3 | — | — | 8 |

TABLE 4-continued

| Formulation | Ethanol (ml) | Methylene Chloride (ml) | Peg (gm) | Glycerine (gm) | CPC (gm) | CHX (gm) | EC (gm) | Eudragite (gm) |
|---|---|---|---|---|---|---|---|---|
| | Coating Solution Compositions | | | | | | | |
| 22 | 1 | 50 | 0.5 | — | 3 | — | — | 8 |
| 23 | 2 | 25 | 0.5 | — | 3 | — | — | 8 |
| 24 | 5 | 25 | 0.5 | — | 3 | — | — | 8 |
| 25 | 10 | 25 | 0.5 | — | 3 | — | — | 8 |
| 26 | 25 | 25 | 0.5 | — | 3 | — | — | 8 |
| 27 | 4 | 50 | — | — | 4 | — | 1 | — |
| 28 | 2 | 30 | 0.5 | — | 3 | — | — | 12 |
| 29 | 5 | 25 | — | 1 | — | 3 | 1 | — |
| 30 | 5 | 25 | — | 1 | — | 3 | — | 1 |

PEG — Polyethylene glycol
CPC — Cetylpyridinium chloride
CHX — Chlorhexidine
EC — Ethyl cellulose

EXAMPLE 31

To test the release of antibacterial agent from toothbrushes prepared according to the invention, representative toothbrushes prepared by immersion in solutions 11, 12, 13, 27 and 30 were then tested by immersion in 5 ml. of water for 3 minutes. At the end of said period each brush was transferred to a new 5 ml. solution of water for an additional 3 minutes. This process was repeated 30 times with the brushes having a polypropylene head and 115 times for the brushes having a styrene acrylonitrile head.

The amount of antibacterial agent released in each sequential immersion was measured by means of u.v. spectrophotometer at 257 nm and 259 nm for chlorhexidine and cetylpyridinium respectively Experiments were triplicated and mean values recorded. Reproducibility was within 8% of the mean. Results are set forth in Table 5 hereinafter.

TABLE 5

| Immersion Number: | Formulation and Amount of Drug Released (mcg/ml) Polypropylene Brushes Solution No. 11 | 12 | 13 | 30 | Styrene Acrylonitrile Brushes Solution No. 11 | 12 | 27 | 30 |
|---|---|---|---|---|---|---|---|---|
| 1 | 1900 | 5700 | 1250 | 1750 | 1700 | 3000 | 1910 | 3500 |
| 2 | 670 | 1300 | 920 | 910 | 890 | 2400 | 1490 | 3100 |
| 3 | 190 | 860 | 560 | 510 | 790 | 1620 | 1020 | 2070 |
| 4 | 210 | 620 | 360 | 450 | 740 | 1100 | 890 | 1570 |
| 5 | 200 | 400 | 290 | 400 | 680 | 700 | 740 | 990 |
| 6 | 220 | 390 | 215 | 320 | 590 | 570 | 670 | 700 |
| 7 | 170 | 280 | 160 | 240 | 570 | 540 | 600 | 640 |
| 8 | 140 | 210 | 140 | 180 | 520 | 450 | 560 | 480 |
| 9 | 115 | 180 | 120 | 110 | 460 | 370 | 420 | 430 |
| 10 | 110 | 170 | 100 | 120 | 450 | 300 | 410 | 420 |
| 11 | 100 | 170 | 100 | 140 | 400 | 280 | 380 | 440 |
| 12 | 90 | 160 | 99 | 138 | 380 | 290 | 348 | 410 |
| 13 | 110 | 147 | 78 | 142 | 208 | 190 | 300 | 350 |
| 14 | 80 | 130 | 70 | 121 | 140 | 230 | 290 | 345 |
| 15 | 82 | 114 | 62 | 108 | 190 | 225 | 280 | 330 |
| 16 | 85 | 140 | 58 | 109 | 185 | 210 | 270 | 300 |
| 17 | 70 | 110 | 50 | 117 | 182 | 208 | 265 | 280 |
| 18 | 75 | 110 | 46 | 105 | 179 | 200 | 260 | 275 |
| 19 | 76 | 100 | 39 | 90 | 160 | 142 | 254 | 272 |
| 20 | 71 | 100 | 35 | 90 | 140 | 180 | 240 | 270 |
| 21 | 60 | 110 | 32 | 80 | 138 | 179 | 236 | 259 |
| 22 | 65 | 90 | 28 | 89 | 125 | 167 | 200 | 241 |
| 23 | 68 | 105 | 28 | 90 | 120 | 162 | 192 | 236 |
| 24 | 60 | 105 | 25 | 68 | 118 | 160 | 190 | 231 |
| 25 | 58 | 100 | 20 | 80 | 117 | 158 | 182 | 228 |
| 26 | 50 | 107 | 25 | 64 | 115 | 156 | 181 | 226 |
| 27 | 55 | 90 | 28 | 52 | 109 | 150 | 172 | 209 |
| 28 | 47 | 117 | 20 | 62 | 108 | 148 | 170 | 198 |
| 29 | 40 | 82 | 20 | 57 | 100 | 142 | 170 | 189 |
| 30 | 40 | 80 | 15 | 50 | 100 | 140 | 168 | 182 |
| 31 | | | | | 98 | 138 | 166 | 181 |

TABLE 5-continued

| Immersion Number: | Formulation and Amount of Drug Released (mcg/ml) Polypropylene Brushes Solution No. 11 | 12 | 13 | 30 | Styrene Acrylonitrile Brushes Solution No. 11 | 12 | 27 | 30 |
|---|---|---|---|---|---|---|---|---|
| 32 | | | | | 99 | 130 | 165 | 180 |
| 33 | | | | | 95 | 128 | 160 | 184 |
| 34 | | | | | 92 | 125 | 158 | 181 |
| 35 | | | | | 91 | 124 | 152 | 179 |
| 36 | | | | | 89 | 122 | 150 | 177 |
| 37 | | | | | 86 | 121 | 148 | 175 |
| 38 | | | | | 84 | 120 | 147 | 174 |
| 39 | | | | | 83 | 119 | 144 | 169 |
| 40 | | | | | 80 | 109 | 142 | 163 |
| 41 | | | | | 78 | 106 | 145 | 160 |
| 42 | | | | | 76 | 104 | 140 | 152 |
| 43 | | | | | 75 | 102 | 138 | 150 |
| 44 | | | | | 73 | 100 | 136 | 145 |
| 45 | | | | | 72 | 100 | 130 | 140 |
| 46 | | | | | 74 | 102 | 134 | 141 |
| 47 | | | | | 70 | 98 | 131 | 139 |
| 48 | | | | | 69 | 96 | 129 | 139 |
| 49 | | | | | 69 | 98 | 120 | 136 |
| 50 | | | | | 68 | 98 | 119 | 132 |
| 51 | | | | | 66 | 96 | 117 | 130 |
| 52 | | | | | 64 | 95 | 116 | 122 |
| 53 | | | | | 64 | 95 | 111 | 120 |
| 54 | | | | | 60 | 93 | 109 | 120 |
| 55 | | | | | 60 | 91 | 108 | 121 |
| 56 | | | | | 55 | 89 | 93 | 119 |
| 57 | | | | | 54 | 88 | 99 | 120 |
| 58 | | | | | 53 | 87 | 96 | 117 |
| 59 | | | | | 50 | 84 | 94 | 115 |
| 60 | | | | | 49 | 82 | 91 | 117 |
| 61 | | | | | 46 | 80 | 89 | 115 |
| 62 | | | | | 45 | 81 | 83 | 109 |
| 63 | | | | | 42 | 80 | 80 | 107 |
| 64 | | | | | 40 | 78 | 81 | 105 |
| 65 | | | | | 40 | 77 | 82 | 104 |
| 66 | | | | | 37 | 78 | 80 | 100 |
| 67 | | | | | 35 | 77 | 87 | 98 |
| 68 | | | | | 33 | 74 | 81 | 96 |
| 69 | | | | | 30 | 76 | 79 | 99 |
| 70 | | | | | 32 | 72 | 78 | 94 |
| 71 | | | | | 29 | 70 | 76 | 93 |
| 72 | | | | | 24 | 70 | 76 | 92 |
| 73 | | | | | 26 | 71 | 78 | 89 |
| 74 | | | | | 28 | 69 | 70 | 90 |
| 75 | | | | | 25 | 64 | 74 | 90 |
| 76 | | | | | 24 | 64 | 77 | 80 |
| 77 | | | | | 22 | 62 | 76 | 78 |
| 78 | | | | | 26 | 60 | 75 | 74 |
| 79 | | | | | 21 | 61 | 72 | 76 |
| 80 | | | | | 20 | 60 | 70 | 72 |
| 81 | | | | | 20 | 58 | 72 | 70 |
| 82 | | | | | 19 | 57 | 69 | 70 |
| 83 | | | | | 20 | 59 | 68 | 64 |
| 84 | | | | | 17 | 54 | 66 | 62 |
| 85 | | | | | 15 | 52 | 67 | 58 |
| 86 | | | | | 16 | 53 | 64 | 56 |

TABLE 5-continued

| Formulation and Amount of Drug Released (mcg/ml) | | | | | | | | |
|---|---|---|---|---|---|---|---|---|
| Immersion | Polypropylene Brushes Solution No. | | | | Styrene Acrylonitrile Brushes Solution No. | | | |
| Number: | 11 | 12 | 13 | 30 | 11 | 12 | 27 | 30 |
| 87 | | | | | 13 | 50 | 63 | 54 |
| 88 | | | | | 14 | 50 | 69 | 50 |
| 89 | | | | | 15 | 48 | 68 | 49 |
| 90 | | | | | 12 | 46 | 67 | 48 |
| 91 | | | | | 11 | 47 | 63 | 51 |
| 92 | | | | | 14 | 42 | 52 | 42 |
| 93 | | | | | | 44 | 60 | 40 |
| 94 | | | | | | 42 | 60 | 41 |
| 95 | | | | | | 40 | 61 | 40 |
| 96 | | | | | | 39 | 59 | 37 |
| 97 | | | | | | 36 | 57 | 37 |
| 98 | | | | | | 32 | 58 | 37 |
| 99 | | | | | | 31 | 56 | 35 |
| 100 | | | | | | 30 | 60 | 30 |
| 101 | | | | | | 30 | 55 | 34 |
| 102 | | | | | | 28 | 54 | 32 |
| 103 | | | | | | 31 | 50 | 29 |
| 104 | | | | | | 27 | 49 | 26 |
| 105 | | | | | | 24 | 48 | 24 |
| 106 | | | | | | 22 | 49 | 22 |
| 107 | | | | | | 20 | 44 | 20 |
| 108 | | | | | | 19 | 45 | 20 |
| 109 | | | | | | 21 | 46 | 20 |
| 110 | | | | | | 15 | 40 | 21 |
| 111 | | | | | | 16 | 39 | 17 |
| 112 | | | | | | 11 | 38 | 15 |
| 113 | | | | | | 12 | 37 | 12 |
| 114 | | | | | | 8 | 36 | 14 |
| 115 | | | | | | 5 | 32 | 16 |

According to J. Dent. Research (64:1356 (1985) the minimal inhibitory concentration and the minimal bactericidal concentration of chlorhexidine diacetate and cetylpyridium chloride are as follows:

| Agent | MIC mcg/ml | MBC mcg/ml |
|---|---|---|
| Chlorhexidine Diacetate | 0.78 | 3.1 |
| Cetylpyridinium Chloride | 3.12 | 6.2 |

MIC: Minimal Inhibitory Conc.
MBC: Minimal Bactericidal Conc.

While the initial rates of release are high due to release of the active ingredient also from the surface of the brush head, these initial release rates are also well below toxic dose of the active ingredient. Nevetheless if these high concentrations are found to be unacceptable by the health authorities, then this problem can be readily solved by carrying out 1 to 5 immersions of the brush prior to the packaging and marketing thereof.

It will be evident to those skilled in the art that the invention is not limited to the details of the foregoing illustrative examples and that the present invention may be embodied in other specific forms without departing from the essential attributes thereof, and it is therefore desired that the present embodiments and examples be considered in all respects as illustrative and not restrictive, reference being made to the appended claims, rather than to the foregoing description, and all changes which come within the meaning and range of equivalency of the claims are therefore intended to be embraced therein.

What is claimed is:

1. A process for producing a toothbrush of the type having a plastic head and bristles terminating in said head and extending therefrom in an array, said toothbrush being characterized by having an antibacterial composition embedded in pores in said head for slow release therefrom into the buccal cavity during the life of the brush said process comprising immersing said head in a solution comprising a solvent capable of creating pores in said plastic head and an antibacterial compound whereby pores are formed in said head and said solution permeates said pores and then evaporating said solvent thereby leaving the antibacterial compound embedded in said toothbrush head for sustained release therefrom into the buccal cavity of a user during uses thereof.

2. A process for producing a toothbrush as claimed in claim 1 wherein said solvent is selected from methylene chloride, acetone, ethylene chloride, methyl acetate and chloroform.

3. A process for producing a toothbrush as claimed in claim 1 wherein said solvent is methylene chloride.

4. A process for producing a toothbrush as claimed in claim 1 wherein said solution further comprises a release enhancer selected from ethanol, cyclohexane, isopropanol, pentane or ethyl acetate.

5. A process for producing a toothbrush as claimed in claim 1 wherein said solution comprises a mixture of methylene chloride and ethanol.

6. A process for producing a toothbrush as claimed in claim 1 wherein said solution further comprises a humectant selected from glycerine, sorbitol hydrogenate, starch hydrolyzate or polyethylene glycol.

7. A process for producing a toothbrush as claimed in claim 1 wherein said antibacterial agent is selected from chlorohexidine and cetylpyridinium chloride.

8. A process for producing a toothbrush as claimed in claim 1 wherein said solution further comprises a hydrophobic polymer or wax.

9. A process for producing a toothbrush as claimed in claim 8 wherein said hydrophobic polymer is selected from stearic acid, cellulose derivatives, polyethylenes, methacrylic acid polymers.

10. A process for producing a toothbrush as claimed in claim 6 wherein said hydrophobic polymer or wax is selected from glyceryl stearate, carnauba wax, stearyl alcohol, ethyl cellulose, polyethylene glycol, cellulose acetate and a methacrylic acid polymer.

* * * * *